US005842884A

United States Patent [19]

Maegawa et al.

[11] Patent Number: 5,842,884

[45] Date of Patent: Dec. 1, 1998

[54] MALE CONNECTOR

[75] Inventors: Akihito Maegawa; Nobuyoshi Tanaka; Yukinori Saka; Kiyofumi Ichida, all of Yokkaichi, Japan

[73] Assignee: Sumitomo Wiring Systems, Ltd., Japan

[21] Appl. No.: 649,027

[22] Filed: May 16, 1996

[30] Foreign Application Priority Data

May 17, 1995 [JP] Japan ..... 7-143910

[51] Int. Cl.[6] ..... H01R 13/40

[52] U.S. Cl. ..... 439/595; 439/701

[58] Field of Search ..... 439/595, 686, 439/381, 597, 600, 701

[56] References Cited

U.S. PATENT DOCUMENTS 4,784,617 11/1988 Oda ..... 439/595

4,820,198 4/1989 Lulko et al. .

4,950,182 8/1990 Zielinski et al. .

5,186,657 2/1993 Abe ..... 439/595

*Primary Examiner*—Khiem Nguyen

*Assistant Examiner*—Eugene G. Byrd

*Attorney, Agent, or Firm*—Banner & Witcoff, Ltd.

[57] ABSTRACT

An electrical connector has a retainer attached from the front side of a terminal fitting insertion chamber. A straightening projection, formed on the upper face of a stopping plate, that effects double-stopping, makes contact with a male terminal from a side opposite to the direction of bending thereof, and bends the male terminal member to thereby straighten it. Easy connection with another connector is thus assured.

7 Claims, 4 Drawing Sheets

MALE CONNECTOR

FIELD OF THE INVENTION

The present invention relates to a male connector containing a male electrical terminal.

BACKGROUND OF THE INVENTION

A conventional male electrical connector is shown in the schematic representation of FIG. 5 hereof. Such a connector comprises a tubular housing 1 having a terminal fitting insertion chamber 4 that allows the insertion of a male terminal 3 having a male terminal member 2 whose leading end is plate-shaped. The insertion of the terminal 3 is effected from the rear opening of the housing 1. A taper 4*a* is formed on the front opening of the terminal fitting insertion chamber 4 for guiding the insertion of the male terminal member 2. Moreover, at the front end of the housing 1, a hood 5 is formed that surrounds the male terminal member 2. A resilient lance 6 is formed on the lower face of the terminal fitting insertion chamber 4 and serves to support and retain the male terminal 3.

When the male terminal 3 is inserted from the rear opening of the terminal fitting insertion chamber 4, its front end projects into the hood 5. As shown in FIG. 6, during manufacture the male terminal 3 has a tendency to bend up (as illustrated), and during insertion it makes contact with the periphery of the front opening but gets guided to the center by means of the tapered face 4*a*.

Thus, in the conventional male connector described above, it is possible to insert the male terminal 3 that has been bent up. However, when a female connector that forms a pair with the male connector is to be fitted, there is a possibility of the bent up male terminal member 2 striking against the front face of the female connector. If this happens, the male and female connectors would fail to engage.

The present invention has been developed taking into account the above problem, and aims at presenting a male connector wherein it is possible to connect a female connector with certainty.

SUMMARY OF THE INVENTION

According to the invention there is provided a male connector comprising a housing, a terminal insertion chamber extending through the housing, and a terminal insertable into said chamber from one end thereof and in use protruding from the other end thereof, the connector further including an alignment member engageable with the housing, adjacent the other end of said chamber, and being adapted to engage and straighten a terminal protruding from said chamber.

Such alignment member ensures that a bent terminal is straightened so as to facilitate connection with the corresponding terminal of another connector.

The alignment member may be a separate component or may be connected to the housing, such as by a hinge or web of an integral plastic moulding.

The alignment member preferably has an inclined face for progressive straightening of the terminal, and in the fully engaged condition may clamp the terminal against the side of the terminal chamber.

The alignment member may be formed on a conventional retainer having a projection engageable with the usual terminal retaining lance. In the preferred embodiment the alignment member is formed on the projection, and together with the housing substantially encircles the terminal.

The housing may include a hood surrounding the terminal. Several terminals may be provided in the connector, each having an alignment member.

BRIEF DESCRIPTION OF THE DRAWINGS

One feature of the invention will be apparent from the following description of the preferred embodiment illustrated by way of example only in the accompanying drawings, in which.

DESCRIPTION OF PREFERRED EMBODIMENT

Figure 1:
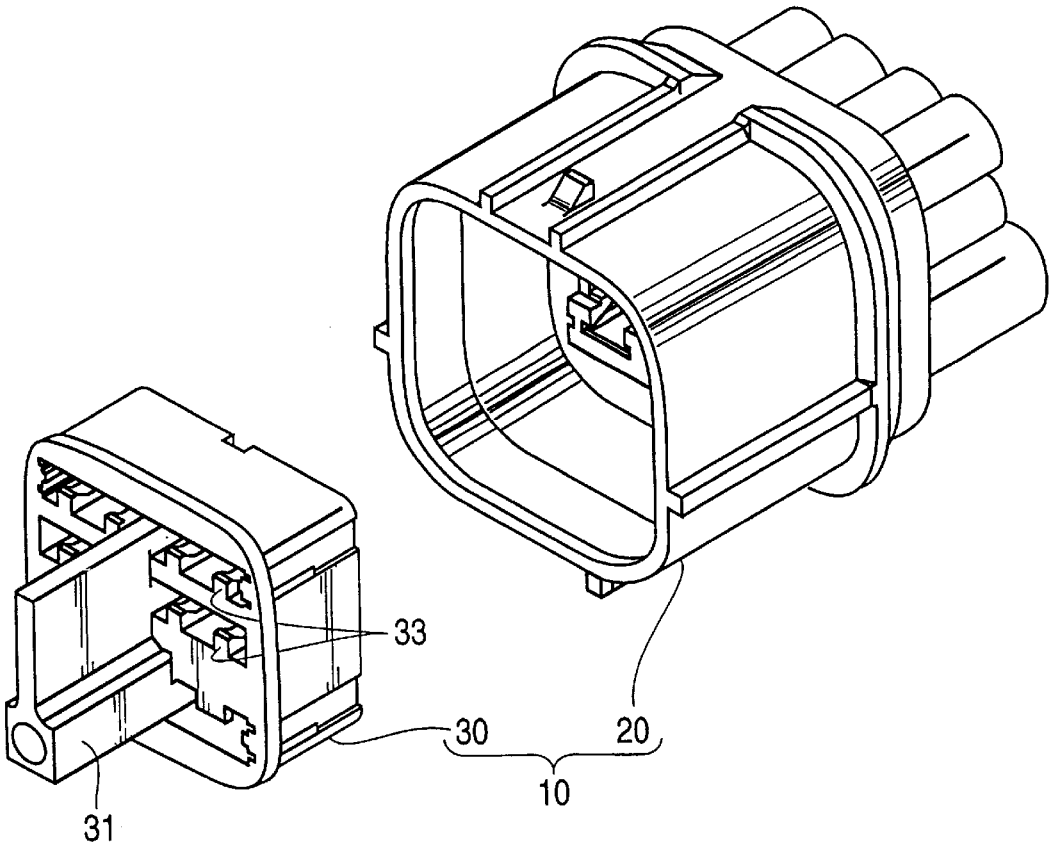
FIG. 1 is an exploded diagonal view of a male connector relating to an embodiment of the present invention.
Figure 2:
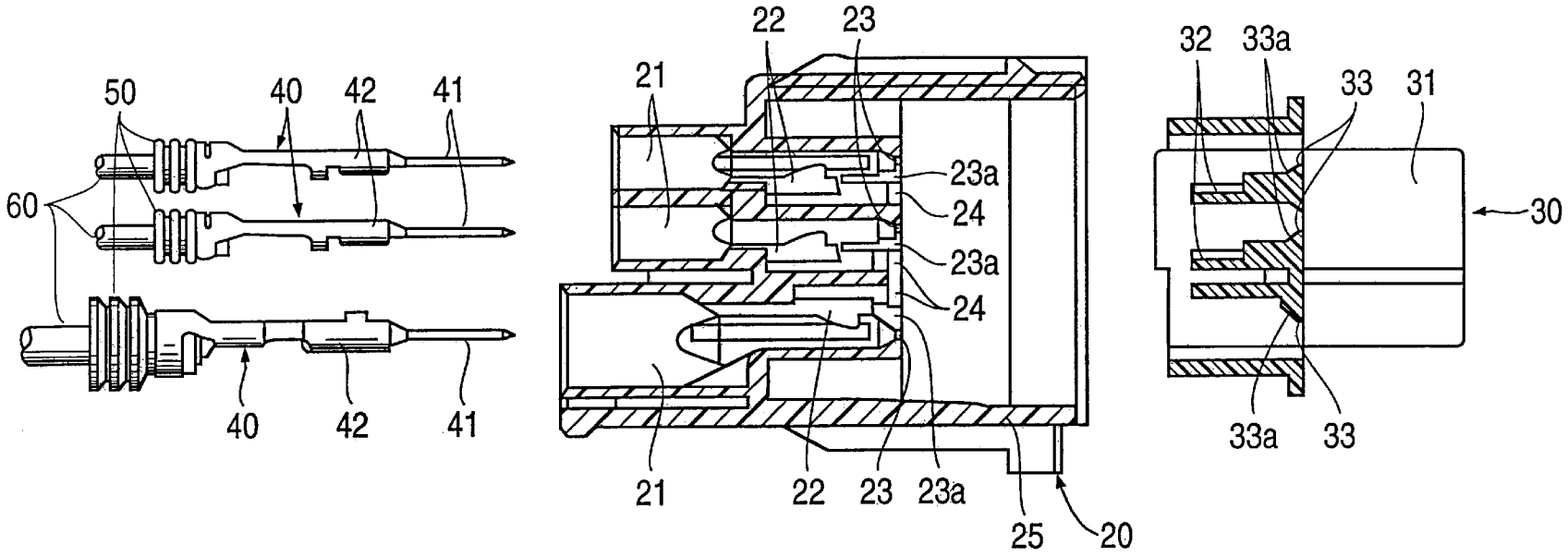
FIG. 2 is a longitudinal cross-section through the male connector before assembly.

FIGS. 1 and 2 show a waterproof male connector 10 comprising a housing 20 having terminal fitting insertion chambers 21 into which are inserted male terminal fittings 40 from the rear, and a retainer 30 that is attached onto the front of the housing 20 and doubly stops male terminal fittings 40 which have been engaged in the terminal fitting insertion chambers 21.

At the rear of the male terminal fittings 40 are provided rubber seals 50 and electrical wires 60 connected by crimping. The male terminal fittings 40 have flat plate-shaped male terminal members 41. Located towards the middle of each chamber 21 is the usual resilient resin lance 22 extending in an axial direction. A projection formed on the upper front end of the resin lance 22 engages the rear end of a box-shaped stopping member 42 formed at the root of the male terminal member 41. This serves to prevent removal and is conventional.

Figure 4:
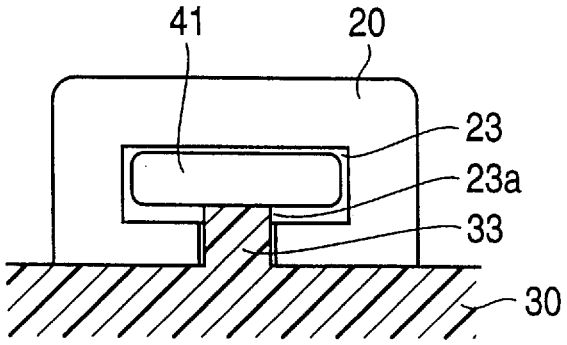
FIG. 4 is a front elevation of a portion of the male connector.
Figure 5:
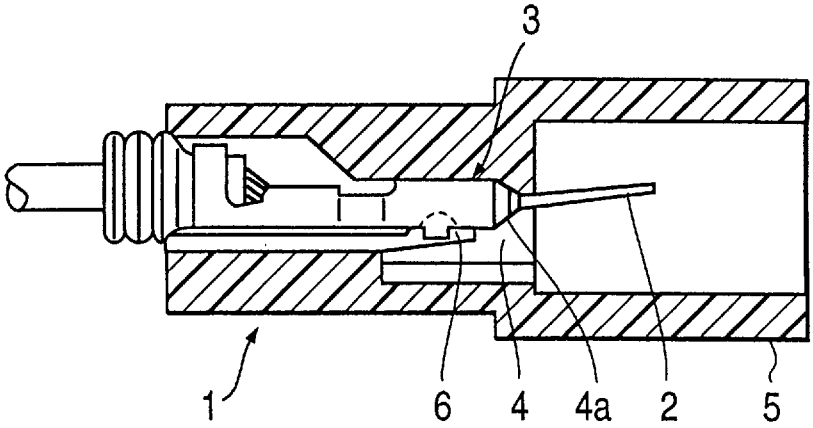
FIG. 5 PRIOR ART
FIG. 5 is a longitudinal cross-section through a conventional male connector.
Figure 6:
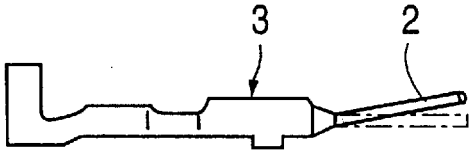
FIG. 6 is a side elevation of a male terminal illustrating the bent-up state.

Flat plate-shaped openings 23 are formed at the front ends of the chambers 21 through which the male terminal members 41 can pass. An opening 24 is also formed adjacent the front end of the resin lance 22. A connection 23*a* passes from the lower face (as viewed) of the peripheral portion of the opening 23 to the opening 24 (Fig.4). A hood 25 is formed so as to surround the front end of the housing 20.

A retainer 30 which constitutes an alignment member is formed into a cap shape so as to cover the front portion of the housing 20 inside the hood member 25. A separation plate 31 is formed so as to project in an up-down direction from the retainer 30 along the transverse center-line.

Stopping projections 32 are formed on the side of the retainer 30 that faces the housing 20. The projections 32 project towards the openings 24. During the attachment of the retainer 30, the projections 32 are inserted into the space below the resin lance 22, and thereby fix the resin lances 22 in place in a conventional manner. Accordingly, each male terminal fitting 40 is doubly stopped when it is in the fully inserted condition.

A straightening projection 33 is formed on the upper face of each stopping projection 32. The straightening projection 33 enters the opening 23 via the connection 23*a*. The straightening projection 33 has an inclined face 33*a* formed on the side facing the housing 20, and as it is engaged, it pushes upwards a male terminal member 41 which may be bent down (as viewed).

The operation of the present embodiment, configured as described above, is now explained.

When the male terminal fitting 40 is inserted into the respective chamber 21, its extreme end passes through the opening 23 and projects therefrom. The stopping member 42 is engaged by the lance 22, and is retained. In this state, the male terminal member 41 may be in the bent state.

Figure 3:
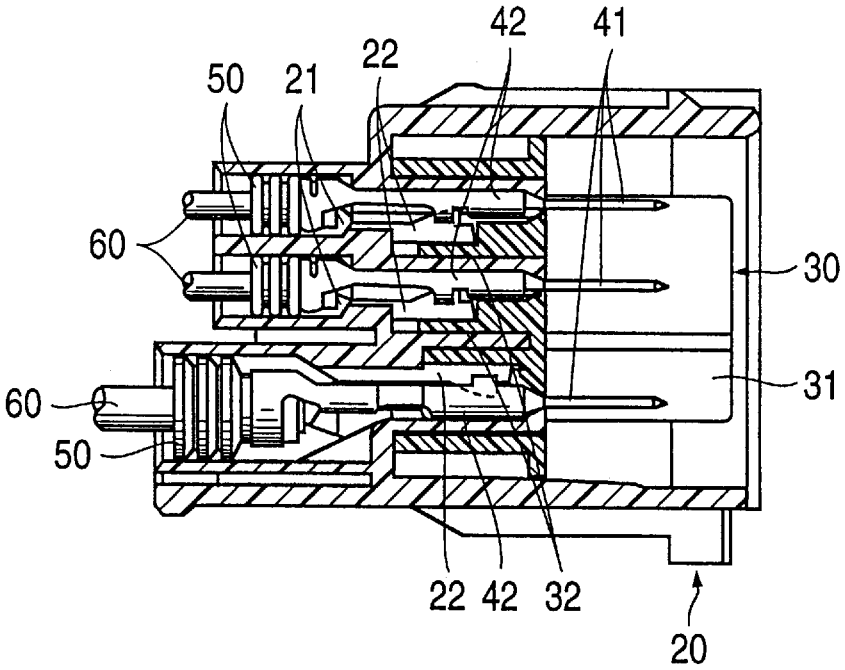
FIG. 3 is a longitudinal cross-section through the male connector after assembly.

When the retainer 30 is inserted from the front side of the housing 20 into the hood member 25 and the stopping projection 32 is inserted into the housing 24, the front end of the male terminal member 41 makes contact with the inclined face 33*a* formed on the straightening projection 33, and is bent and pushed upwards along the inclined face 33*a*. FIGS. 3 and 4 show the retainer 30 pushed up to the end.

The inclined projection 33 passes under the lower face of the male terminal member 41 and ensures that the male terminal member 41 bends upwards. The projection 33 finally enters the opening 23 via the connection 23*a*, and stops so that the lower face of the male terminal member 41 pushes against the upper face of the opening 23. As a result, the male terminal member 41 is pushed from a direction opposite to the direction of its bending and the bend is straightened. The terminal member 41 is securely clamped on both sides thereby assuring that the member is straight within normally acceptable production tolerances.

In other words, when the retainer 30 is attached from the front side of the terminal chamber 21, the projection 33, formed on the upper face of the stopping plate 32 makes contact with the male terminal member 41 from a side opposite to the direction of bending and bends the male terminal member 41 in the other direction so as to straighten it. In this way, in the present embodiment, the straightening of the male terminal fitting 40 is carried out by attaching the retainer 30 to the male connector 10, the retainer 30 being a separate piece that is used as a straightening device and that is attached afterwards.

However, in order to carry out the straightening of the male terminal member 41, it is not absolutely necessary to have a separate piece. For example, in order to push and bend the male terminal member 41 in a direction opposite to the direction of bending, a straightening mechanism constituted by an inclination or the like may equally be formed on the opening 23 to bend the male terminal member 41 in the opposite direction. Of course, it may equally be arranged that a retainer is used that has separate parts or is connected in parts by means of a hinge member or the like. Furthermore, it goes without saying that the male connector need not be of the waterproof type.

In the present embodiment, it is arranged that the inclined face 33*a* that serves as a guiding inclined face is formed on the retainer 30 which constitutes the straightening device, the male terminal member 41 being pushed into place from above, and the inclined face 33*a* entering the housing 20. However, it is not necessary that it enter the housing 20; it may be equally arranged so that it bends the male terminal member 41 upwards at the outer side of the housing 20.

We claim:

1. A male connector comprising a housing having a first chamber extending through the housing and a second chamber adjacent said first chamber and communicating therewith via an opening, said second chamber having a support surface opposite said opening, a terminal insertable into said first chamber from one end thereof and in use protruding from the other end thereof, and an alignment member engageable with the housing adjacent the other end of the chamber, said alignment member including an aperture for receiving the terminal therethrough and a projection receivable into said second chamber, said projection having an inclined surface adjacent the aperture, said inclined surface extending through said opening and into said first chamber to engage one side of said terminal protruding from said first chamber and urge the other side of the terminal against a side wall of the first chamber as said projection is moved into said second chamber so that the terminal is straightened and held in a substantially straight position between the inclined face of the projection supported by said support face and said side wall of the first chamber.

2. A connector according to claim 1 wherein in use said terminal protrudes from said chamber along an axis and said alignment member is engageable with said housing in the direction of said axis.

3. A connector according to claim 1 wherein said alignment member comprises a retainer operative to latch a terminal in said chamber.

4. A connector according to claim 3 wherein said housing further includes a resilient lance having a protrusion engageable in a recess of a terminal, and said retainer includes a projection adapted to prevent movement of said lance in a disengagement direction.

5. A connector according to claim 1 wherein said housing and alignment member together are adapted to substantially encircle said terminal.

6. A connector according to claim 1 wherein said chamber includes an inwardly inclined face at said other end thereof.

7. A connector according to claim 1 and having a plurality of said chambers, an alignment member being provided for each of said terminals and comprising a unitary component.

* * * * *